US005104762A

United States Patent [19]

Shirose et al.

[11] Patent Number: 5,104,762

[45] Date of Patent: Apr. 14, 1992

[54] DEVELOPER FOR ELECTROPHOTOGRAPHY

[75] Inventors: Meizo Shirose; Hiroyuki Takagiwa, both of Hachioji; Michiaki Ishikawa, Hino; Yoshiki Nishimori, Hachioji, all of Japan

[73] Assignee: Konica Corporation, Tokyo, Japan

[21] Appl. No.: 644,438

[22] Filed: Jan. 22, 1991

[30] Foreign Application Priority Data

Jan. 31, 1990 [JP] Japan ..... 2-19123

[51] Int. Cl.[5] ..... G03G 9/107; G03G 9/097; G03G 9/087

[52] U.S. Cl. ..... 430/106.6; 430/108; 430/110

[58] Field of Search ..... 430/106.6, 108, 110

[56] References Cited

U.S. PATENT DOCUMENTS

| | | | |
|---|---|---|---|
| 4,902,570 | 7/1990 | Heinemann et al. | 430/110 X |
| 4,902,598 | 2/1990 | Winnik et al. | 430/110 |
| 4,920,023 | 4/1990 | Koch et al. | 430/108 X |
| 5,021,317 | 6/1991 | Matsubara et al. | 430/110 |

FOREIGN PATENT DOCUMENTS

| | | | |
|---|---|---|---|
| 166651 | 12/1980 | Japan | 430/110 |
| 1-24867 | 5/1989 | Japan | 430/110 |
| 1-80563 | 7/1989 | Japan | 430/108 |

*Primary Examiner*—Roland Martin
*Attorney, Agent, or Firm*—Finnegan, Henderson, Farabow, Garrett, and Dunner

[57] ABSTRACT

A developer for electrophotography is disclosed. The developer comprises a carrier comprising magnetic particles being coated with a fluororesin in which an alkali salt of a fatty acid is contained in an amount of from 0.05 to 0.5% by weight of said carrier, and a toner comprising a colored particle comprising a colorant and a reaction product of a styrene-acryl copolymer having carboxyl groups with a multivalent metal compound, and an inorganic particle containing an ammonium salt-modified polysiloxane. The developer is excellent in the reproducibility of fine line, the density uniformity of solid image and the fine line-reproducibility in copies formed by successive generations and the durability.

10 Claims, No Drawings

DEVELOPER FOR ELECTROPHOTOGRAPHY

FIELD OF THE INVENTION

The present invention relates to a developer for developing an electrophotographic image comprising a carrier and a toner.

BACKGROUND OF THE INVENTION

As a developer used for electrophotography there is known a two-component developer comprising a toner and a carrier.

As the carrier there is conventionally known a resin-coated carrier prepared by coating a fluororesin on the surface of magnetic particles in order to prevent a toner substance from sticking onto the surface as described in Japanese Patent O.P.I. Publication (hereinafter referred to as JP O.P.I.) Nos. 209754/1983, 16617/1985 and 240758/1984.

As the toner there is known a toner which, in order to improve the fixability and fluidity thereof, comprises colored particles and hydrophobic silica particles, in which the colored particles contain a resin obtained by the reaction between the carboxy group present in a copolymer component and a multivalent metal compound, as described in JP O.P.I. No. 217358/1988.

However, a developer comprising the fluororesin-coated carrier is so poor in the powder fluidity that the developer, when supplied to a developing area, is liable to form a layer having an uneven thickness to result in the formation of an image having poor fine line reproducibility and solid image density uniformity; is fogged soon to have a poor durability; and has a problem that, when used in continued generation-to-generation copying from a copied image, the fine-line details are liable to blur even in an earlier generation copy image.

SUMMARY OF THE INVENTION

It is an object of the present invention to provide a developer for electrophotography which satisfies the following requirements: To be (i) capable of forming an image excellent in the fine line reproducibility, (2) capable of forming an image excellent in the solid density uniformity, (3) capable of forming an image with no fine line blur in generation copies, and (4) hardly fogged to have a high durability.

The above object is accomplished by a developer comprising a carrier comprising magnetic particles being coated with a fluororesin, in which an alkali salt of a fatty acid is contained in an amount of from 0.05 to 0.5% by weight of said carrier, and a toner comprising a colored particle comprising a colorant and a reaction product of a styrene-acryl copolymer having carboxyl groups with a multivalent metal compound, and an inorganic particle containing an ammonium salt-modified polysiloxane having a component represented by the following Formula A;

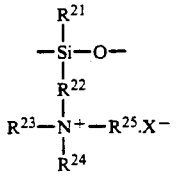

wherein $R^{21}$ is a hydrogen atom, a hydroxyl group, an alkyl group, an aryl group, an alkoxy group or a group of

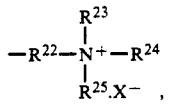

in which $R^{22}$ is a linkage group, $R^{23}$, $R^{24}$ and $R^{25}$ each represent a hydrogen atom, an alkyl group or an aryl group; and X is a halogen atom, provided that $R^{21}$, $R^{22}$, $R^{23}$, $R^{24}$ and $R^{25}$ each may have a substituent.

DETAILED DESCRIPTION OF THE INVENTION

According to the construction of the invention, in the carrier, a fatty acid alkali metal salt, rather than a mere fatty acid metal salt, is contained in a specific proportion such as 0.05 to 0.5% by weight of the carrier in the surface of a fluororesin coat layer, so that the fluidity of the carrier can be raised without adversely affecting the triboelectric charging characteristic thereof, which thus makes it possible to supply a developer layer having a highly uniform thickness to a developing area.

And in the toner, a reaction product of a styrene-acryl copolymer resin carboxy group with a multivalent metal compound is contained in colored particles and at the same time inorganic particles containing ammonium salt-modified polysiloxane is used, so that the chemical affinity between the resin's functional group, the ammonium base on the inorganic particles surface and the polar group on the photoreceptor surface is strengthened, and as a result, the toner particles electrostatically sticking onto the photoreceptor surface by development do not move even when subjected to pressure by the nip rollers of a developing device, thus enabling to improve the fine line reproducibility, and the inorganic particles, due to the strong chemical affinity, firmly sticks onto the colored particles surface to thereby cause the toner to moderately grind the surface of the photoreceptor or of the carrier to result in efficient removal of the stain therefrom.

Therefore, the developer of the invention, due to the synergistic effect of the carrier and the toner, can reproduce a high-quality image having excellent fine line reproducibility, excellent solid image density uniformity and no fine-line blur even in a later generation copy formation, and is so effectively prevented from being fogged that the durability thereof is remarkably improved.

If a fatty acid metal salt other than the fatty acid alkali metal salt is used, the coated carrier's triboelectric charging characteristic changes to bring about triboelectric charging between the carrier particles to largely lower the fluidity characteristic thereof, resulting in the deteriorations of the fine line reproducibility and solid image density uniformity and the formation of an image with fine line blur in a later generation copy.

If the styrene-acryl copolymer resin contained in the colored particles has no functional group such as a carboxy group, and if no ammonium salt is present on the inorganic particles' surface, the chemical affinity between the colored particles and the inorganic particles is so small that the toner can not exhibit its grinding characteristic, so that the surface of the photoreceptor or carrier is not cleared of the stain substance thereon, and as a result the durability of the developer is lowered. Further, the chemical affinity between the toner and the photoreceptor also is so small as to make the toner particles electrostatically sticking by development onto the photoreceptor surface liable to move when subjected to pressure by the nip rollers in the developing process, whereby the fine line reproducibility is deteriorated.

The fatty acid alkali metal salt content of the resin coat layer is 0.05 to 0.5% by weight to the weight of carrier as previously stated, but if the content is too small, the carrier's fluidity is so insufficient as to deteriorate the solid image density uniformity, leading to the formation of an image with fine line blur in a later generation copy, while if the content exceeds the range, it increases the adhesion characteristic of the carrier surface and raises the surface energy to thereby deteriorate the fine line reproducibility and solid density uniformity, resulting in the form an image with fine line blur in a later generation copy.

Useful examples of the resin used as the resin coat layer for the carrier are those as described in JP O.P.I. No. 9470/1989, which include poly(vinylidene fluoride), poly(ethylene tetrafluoride), vinylidene fluoride-ethylene tetrafluorides such as acrylic acid-1,1-dihydroperfluoroethyl copolymer, and a copolymer of acrylic acid-1,1,3-trihydroperfluoro-n-propyl with acrylic acid-1,1-dihydroperfluoro-n-propyl.

The thickness of the resin coat layer is preferably 0.5 to 3.0 μm.

As the magnetic particles as the core material of the carrier there may be used conventional ones including ferrite and magnetite.

The fatty acid alkali metal salt contained in the surface of the resin coat layer is one obtained by the reaction of a fatty acid and an alkali metal. Examples of the fatty acid include lauric acid, palmitic acid, stearic acid, oleic acid and a mixture thereof. Examples of the alkali metal include lithium, sodium and potassium. Preferred among these salts is a fatty acid salt of lithium, which is useful for remarkably improving the fluidity characteristic of the carrier.

The fatty acid alkali metal salt content of the carrier is required to be in the range of 0.05 to 0.5% by weight of the carrier as aforementioned.

Incorporation of the fatty acid alkali metal salt into the surface of resin coat layer is carried out in the manner that a fluororesin coat layer is formed on the magnetic particles surface, and then the magnetic particles are mixed with fatty acid alkali metal salt powder to thereby cover the resin coat layer surface with the fatty acid alkali metal salt powder.

The fatty acid alkali metal salt content of the fluororesin coat layer can be determined according to the following procedure, wherein explanation will be made for the case where the fatty acid alkali metal salt is potassium stearate.

(1) About 5 g of a coated carrier are put in a 100 cc beaker and then stirred.

(2) Acetone is added to the carrier, and a magnet is arranged at the bottom of the beaker to fix the carrier by its magnetic force to the bottom so that the carrier is not allowed to flow but the resin coat layer alone can be dissolved.

(3) The above step (2) is repeated to completely dissolve the resin coat layer.

(4) The magnetic particles remaining in the beaker is dried on a hot plate.

(5) The whole weight of the magnetic particles is measured.

(6) The coating rate is found from the equation (1):

$$\text{Coating rate} = \frac{A - B}{A} \times 100 \text{ (\% by weight)}$$

wherein A is the whole weight of the coated carrier, and B is the whole weight of the magnetic particles.

(7) About 100 g of the coated carrier are put in a 1 liter beaker and stirred, and the above step (2) is repeated to dissolve the resin coat layer.

(8) The coat layer-dissolved solution was evaporated by an evaporator to remove the solvent therefrom, and further dried under reduced pressure.

(9) The residual resin was made into pellets to be subjected to an elementary analysis such as a fluorescent X-ray analysis method to thereby determine the amount of potassium stearate contained in the resin.

(10) The potassium stearate content rate M of the coated carrier is found according to the following equation (2):

$$M = \frac{C \times D}{100} \text{ (\% by weight)}$$

wherein C is the coating rate (% by weight) defined by the previous equation (1), and D is the potassium stearate content (% by weight) of the resin.

The resin comprising the colored particles of the toner is a styrene-acryl copolymer resin obtained by the reaction of a carboxy group present in a copolymer component and a multi-valent metal compound, wherein the carboxy group serves for the formation of a cross-linkage by the reaction with a multi-valent metal compound.

The above specific styrene-acryl copolymer resin is obtained by the reaction of a carboxy group-having styrene-acryl copolymer and a multivalent metal compound. The styrene-acryl copolymer can be obtained by copolymerization of at least one styrene monomer and at least one acryl monomer, which is preferably acrylic acid, methacrylic acid or a derivative thereof and required to have at least one carboxy group.

As the carboxy group-having monomer there may be suitably used a partially esterified compound obtained by the esterification reaction of a hydroxy group-having acrylate or methacrylate or a derivative thereof and a dicarboxylic compound.

In the above partially esterified compound, since a carboxy group is introduced in a position less affecting the principal chain construction, the steric hindrance by the group to the chemical structure thereof is lessened, and as a result the reaction of the carboxy group and a hereinafter described multivalent metal compound makes efficient progress to form an ionic bond, whereby a resin having a good bridged structure can be obtained.

Examples of the multivalent metallic element to constitute the multivalent metal compound include Cu, Be, Mg, Ca, Sr, Ba, Zn, Cd, Al, Ti, Ge, Sn, V, Cr, Mo, Mn, Fe, Ni, Co, Zr and Se.

As the multivalent metal compound containing any of these metals there may be used the fluorides, chlorides, chlorates, bromides, iodides, oxides, hydroxides, sulfides, sulfites, acetates and sulfates of these metals. Particularly preferred among them are the acetates and oxides of the above metals.

The colored particles comprise the above styrene-acryl copolymer resin as the essential component thereof and a colorant.

As the inorganic particles constituting the toner there may be used inorganic particles treated with an ammonium salt-modified polysiloxane.

The ammonium salt-modified polysiloxane is a polysiloxane having an ammonium salt.

The ammonium base-having polysiloxane is generally a polysiloxane containing a constituent unit represented by the foregoing Formula A, and more particularly a compound represented by the following Formula B:

Formula B

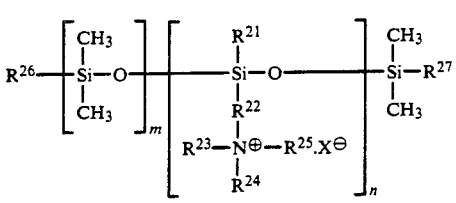

wherein $R^{26}$ and $R^{27}$ each represent a hydrogen atom, a hydroxy group, an alkyl group, an aryl group or an alkoxy group, which groups each may have a substituent; $R^{21}$, $R^{22}$, $R^{23}$, $R^{24}$, $R^{25}$ and X are as defined previously in Formula A; and m and n each represent an integer of 1 or more.

To be concrete, there are the following compounds having Formulas 1 and 2:

Formula 1

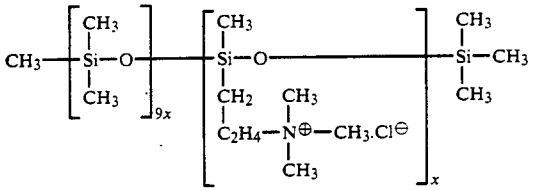

(x is an integer)

Formula 2

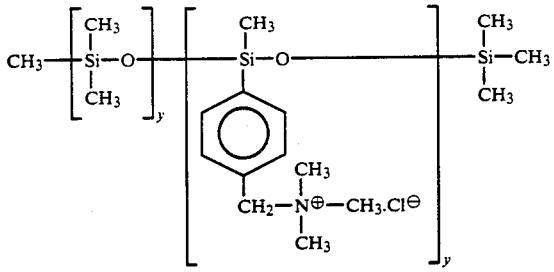

(y is an integer)

Useful examples of the inorganic particles containing an ammonium salt-modified polysiloxane include particles of silica, alumina, titanium oxide, barium titanate, magnesium titanate, calcium titanate, strontium titanate, zinc oxide, chromium oxide, cerium oxide, antimony trioxide, zirconium oxide and silicon carbide.

The surface of the inorganic particle is treated with the ammonium salt-modified polysiloxane. Treating the inorganic particles surface with the ammonium salt-modified polysiloxane may be carried out by known techniques, which include (1) a method in which inorganic particles are dispersed in a solution of an ammonium salt-modified polysiloxane dissolved in a solvent, the dispersion is filtered or subjected to a spray-dry treatment to remove the solvent therefrom, and then heated to be hardened, and (2) a method in which inorganic particles are subjected by using a fluidifying bed device to spray-coating of a solution of an ammonium salt-modified polysiloxane dissolved in a solvent, and then dried by heating to remove the solvent therefrom to thereby harden the coat layer.

The average primary particle size of the inorganic particles containing the ammonium salt-modified polysiloxane is preferably 3 nm to 2 μm, and more preferably 5 nm to 500 nm. The specific surface area of the inorganic particles according to a BET method is normally 20 to 500 $m^2/g$.

The inorganic particles treated with ammonium salt-modified polysiloxane are mixed with the colored particles. The adding proportion of the inorganic particles is preferably 0.1% to 2% by weight, and more preferably 0.2% to 1% by weight of the colored particles.

EXAMPLES

In the following examples and comparative examples, the term 'parts' represents 'parts by weight.'

Preparation of carriers

(1) Carrier a (comparison)

A coating liquid was prepared by dissolving 12 g of ethylene fluoride/ethylene tetrafluoride copolymer in 500 ml of acetone/methylethyl ketone (1/1) mixed solvent. This coating liquid was used to form a resin coat layer having an average thickness of about 2 μm on the surface of spheric ferrite particles by using a Spira coater, whereby a comparative coated carrier a was obtained.

(2) Carrier b (comparison)

A coated carrier b was obtained by forming a resin coat layer in the same manner as in Carrier a except that the coating liquid in Carrier a was replaced by a coating liquid prepared by dissolving 12 g of acrylic acid-1,1-dihydroperfluoroethyl copolymer in 500 ml of acetone.

(3) Carrier c (comparison)

A coating liquid was prepared by dissolving 15 g of styrene/methyl methacrylate copolymer in 300 ml of methylethyl ketone, and this coating liquid was used to form a undercoat layer having an average thickness of 1 μm on the surface of spheric ferrite particles by using a Spira coater. Next, another coating liquid was prepared by dissolving 12 g of acrylic acid-1,1,3-trihydroperfluoro-n-propyl/acrylic acid-1,1-dihydroperfluoro-n-propyl copolymer in 500 ml of acetone, and this coating liquid was used to form an overcoat layer on the above undercoat layer by using a Spira coater. thus forming resin coat layers of which the total average thickness was about 2 μm, whereby a comparative Carrier c was obtained.

(4) Carrier A (invention)

One kilogram of Carrier c and 1 g of litium stearate were put in a V-type mixer 'Micro-Type See-Through Mixer', manufactured by Tsutsui Rikagaku Co., and mixed at 70 rpm for 20 minutes, whereby a Carrier A comprising a resin coat layer containing lithium stearate in the surface thereof was obtained.

(5) Carrier B (invention)

A Carrier B comprising a resin coat layer containing lithium stearate in the surface thereof was prepared in the same manner as in Carrier A except that the amount of the lithium stearate in the preparation of Carrier A was changed to 500 mg.

(6) Carrier d (comparison)

A comparative Carrier d comprising a resin coat layer containing lithium stearate in the surface thereof was prepared in the same manner as in Carrier A except that the amount of the lithium stearate was changed to 200 mg.

(7) Carrier C (invention)

A Carrier C comprising a resin coat layer containing lithium stearate in the surface thereof was prepared in the same manner as in Carrier A except that the Carrier c was replaced by Carrier a.

(8) Carrier D (invention)

A Carrier D comprising a resin coat layer containing lithium stearate in the surface thereof was prepared in the same manner as in Carrier A except that the Carrier c was replaced by Carrier b.

(9) Carrier E (invention)

A Carrier E comprising a resin coat layer containing potassium palmitate in the surface thereof was prepared in the same manner as in Carrier A except that the lithium stearate in the preparation of Carrier A was replaced by potassium palmitate.

(10) Carrier F (invention)

A Carrier F comprising a resin coat layer containing lithium stearate in the surface thereof was prepared in the same manner as in Carrier A except that the amount of the lithium stearate was changed to 5 g.

(11) Carrier e (comparison)

A Carrier e comprising a resin coat layer containing lithium stearate in the surface thereof was prepared in the same manner as in Carrier A except that the lithium stearate was replaced by magnesium stearate.

(12) Carrier f (comparison)

A Carrier f comprising a resin coat layer containing lithium stearate in the surface thereof was prepared in the same manner as in Carrier A except that the amount of the lithium stearate was changed to 7 g.

Preparation of resins for colored particles (1) Resin A (invention)

A metal-bridged styrene-acryl copolymer Resin A having a molecular weight distribution with two peaks, a weight average molecular weight Mw of 170,000 and a number average molecular weight Mn of 9,000 was prepared by the copolymerization reaction of 72 parts of styrene, 10 parts of methyl methacrylate, 14 parts of butyl acrylate, 4 parts of monoacryloyloxyethyl succinate and 0.4 part of zinc oxide.

(2) Resin B (invention)

A metal-bridged styrene-acryl copolymer Resin B having a molecular weight distribution with two peaks, a weight average molecular weight Mw of 186,000 and a number average molecular weight Mn of 10,000 was prepared by the copolymerization reaction of 82 parts of styrene, 14 parts of butyl acrylate, 4 parts of monoacryloyloxyethyl isophthalate and 0.6 part of magnesium oxide.

(3) Resin a (comparison)

A non-metal-bridged styrene-acryl copolymer Resin a having a molecular weight distribution with two peaks, a weight average molecular weight Mw of 152,000 and a number average molecular weight Mn of 6,800 was prepared by the copolymerization reaction of 82 parts of styrene and 18 parts of n-butyl methacrylate.

Preparation of colored particles (1) Colored particles A (invention)

| | |
|---|---|
| The above resin A | 100 parts |
| Carbon black 'Mogal L' produced by Cabot Co. | 10 parts |

were mixed, moltenly mixed, cooled, pulverized, pulverized, and then classified, whereby colored particles A having an average particle size of 10 μm obtained.

(2) Colored particles B (invention)

Colored particles B having an average particle size of 10 μm was prepared in the same manner as in Colored particles A except that the Resin A was replaced by Resin B.

(3) Colored particles a (comparison)

Colored particles a was prepared in the same manner as in Colored particles A except that the Resin A was replaced by Resin a.

Preparation of inorqanic particles (1) Inorganic particles A (invention)

A polysiloxane having an ammonium salt represented by the foregoing Formula 1 was dissolved in xylene to prepare a treating solution.

Next, a silica powder 'Aerosil 200', produced by Nippon Aerosil Co., was put in a mixer, and to the silica particles was sprayed the above treating solution so that the polysiloxane accounts for 5% by weight of the silica particles, and then this was put in a flask and stirred at 100° C. over a period of hours to remove the xylene therefrom, whereby Inorganic particles A surface-treated with the polysiloxane having an ammonium salt was prepared. The obtained Inorganic particles A had an average primary particle diameter of 12 nm and a specific surface area of according to a BET method.

(2) Inorganic particles B (invention)

A polysiloxane having an ammonium salt represented by the foregoing Formula 2 was dissolved in xylene to obtain a treating solution.

Next, a silica powder 'Aerosil 300', produced by Nippon Aerosil Co., was put in a mixer, and to the silica particles was sprayed the above treating solution so that the polysiloxane accounts for 17% by weight of the polysiloxane. The subsequent procedure was performed in the same manner as in Inorganic particles A, whereby Inorganic particles B surface-treated with the polysiloxane having an ammonium salt as a functional group was prepared. The obtained Inorganic particles B had an average primary particle diameter of 7 nm and a specific surface area of 126 $m^2/g$ according to a BET method.

(3) Inorganic particles a (comparison)

A silica powder 'Aerosil 200', produced by Nippon Aerosil Co., was put in a hermetical-type Henshel mixer heated to 100° C., and to the silica powder, with rapidly stirring, was sprayed an isopropyl alcohol solution of amino group-containing silicone oil (viscosity: 1200 cps, amino equivalent 3500) so that the amino group-containing silicone oil accounts for 2.0% by weight of the silica powder, and then this was dried at 150° C., whereby comparative Inorganic particles a surface-treated with the amino group-containing silicone oil was prepared.

Preparation of the invention and comparative examples

In the preparation of the invention and comparative examples, the combinations of the colored particles, inorganic particles and carriers shown in Table 1 were used. Firstly, the inorganic particles and the colored particles were mixed by means of a Henshel mixer to have the inorganic particles stick onto the surface of the colored particles to thereby prepare a toner, and then the toner and the carrier were mixed by means of a V-type mixer, whereby each two-component developer was prepared.

In each developer, the weight ratio of the colored particles, inorganic particles and carrier was 500:3:9500.

Evaluation

Each of the above developers was used to make a copy image forming test run in an electrophotographic copier U-Bix 1017, manufactured by KONICA Corporation, and evaluated with respect to the following items:

1. Fine line reproducibility

The copied image was observed visually to judge the fine line reproducibility by examining the number of well reproduced fine lines per millimeter. The larger the number of fine lines, the more excellent the fine line reproducibility.

2 Solid image density uniformity

A 5 cm×5 cm-size solid density original having a density of 1.3 was copied to judge the density uniformity by examining the density ratio of the maximum density and the minimum density of the copied image. The closer to 1 the density ratio, the higher the image density uniformity.

3. Fine line blur in generation copying

In making generation copies, judgement was made by examining how many 5-lines/mm-image-well-reproducible generations are there before the occurrence of fine line blur, wherein the term 'generation copying' means that an initially copied image is used as an original the first generation to be further copied to make the second generation, thus repeating the procedure to reproduce one generation to the subsequent generations.

4. Durability

A test run of continuous image copy formatiom over 200,000 times in maximum was performed, a SAKURA Densitometer, manufactured by KONICA Corporation, was used to measure the relative densities of the white background of the copies, and the maximum value of the number of copies having a density of not more than 0.01 was found and evaluated for the durability. The larger the value, the more excellent the durability.

The results are shown in Table 1.

TABLE 1

| | Two-component developer | | | Evaluation | | | |
|---|---|---|---|---|---|---|---|
| | | Toner | | | | | |
| Example | Carrier | Colored particles | Inorganic particles | Fine line reproducibility | Solid density uniformity | Generations before fine line blur occurrence | Durability |
| Example 1 | A | A | A | 12 lines/mm | 0.98 | 7 generations | 200,000 copies |
| Example 2 | B | B | A | 12 lines/mm | 0.98 | 7 generations | 200,000 copies |
| Example 3 | C | A | A | 12 lines/mm | 0.99 | 7 generations | 200,000 copies |
| Example 4 | D | B | B | 12 lines/mm | 0.98 | 7 generations | 200,000 copies |
| Example 5 | E | A | B | 12 lines/mm | 0.97 | 7 generations | 200,000 copies |
| Example 6 | F | B | B | 12 lines/mm | 0.98 | 7 generations | 200,000 copies |
| Example 7 | E | A | A | 12 lines/mm | 0.99 | 7 generations | 200,000 copies |
| Comp. ex. 1 | a | A | A | 5 lines/mm | 0.87 | 2 generations | 200,000 copies |
| Comp. ex. 2 | b | B | B | 5 lines/mm | 0.83 | 2 generations | 200,000 copies |
| Comp. ex. 3 | c | a | a | 4 lines/mm | 0.85 | 1 generation | 30,000 copies |
| Comp. ex. 4 | d | A | A | 6 lines/mm | 0.87 | 3 generations | 200,000 copies |
| Comp. ex. 5 | e | B | B | 4 lines/mm | 0.81 | 2 generations | 200,000 copies |
| Comp. ex. 6 | f | A | B | 5 lines/mm | 0.84 | 3 generations | 200,000 copies |
| Comp. ex. 7 | A | a | A | 10 lines/mm | 0.90 | 5 generations | 40,000 copies |
| Comp. ex. 8 | B | A | a | 10 lines/mm | 0.92 | 5 generations | 30,000 copies |

As is apparent from the results shown in Table 1, each of the developers in Examples 1 to 7 forms an excellent copy image having good fine line reproducibility and solid density uniformity without fine line blur occurrence even in generation copying, and is subjected to so sufficient antifogging treatment as to have a remarkably excellent durability.

In contrast, the developers of Comparative examples 1 to 3 contain no fatty acid alkali metal salts, so that they have inferior fine line reproducibility and solid density uniformity with a tendency to fine line blur occurrence in generation copying.

In the developer of Comparative example 4, the fatty acid alkali metal salt content thereof is so small that the developer is inferior in the fine line reproducibility and solid density uniformity with a tendency to fine line blur occurrence in generation copying.

The developer of Comparative example 5 contains a fatty acid alkaline earth metal salt instead of the fatty acid alkali metal salt, so that the coated carrier's triboelectric charging characteristic changes to deteriorate the fine line reproducibility and solid density uniformity, thus causing fine line blur to occur in generation copying.

In the developer of Comparative example 6, the fatty acid alkali metal salt content thereof is so high that the developer has inferior fine line reproducibility and solid density uniformity, and therefore tends to cause fine line blur to occur in generation copying.

In the developer of Comparative example 7, the resin of its colored particles is different from the specific styrene-acryl copolymer resin of the invention, while in that of Comparative example 8, its inorganic particles are not treated with ammonium salt-modified polysiloxane, so that both the developers can not achieve fine line reproduction sufficiently with fine line blur occurrence to some extent and have a poor durability.

What is claimed is:

1. A developer for electrophotography comprising a carrier comprising magnetic particles being coated with a fluororesin in which an alkali salt of a fatty acid is contained in an amount of from 0.05 to 0.5% by weight of said carrier, and a toner comprising a colored particle comprising a colorant and a reaction product of a styrene-acryl copolymer having carboxyl groups with a multivalent metal compound, and an inorganic particle containing an ammonium salt-modified polysiloxane having a component represented by the following formula A:

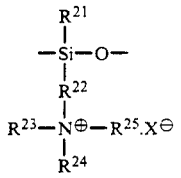

(A)

wherein $R^{21}$ is a hydrogen atom, a hydroxyl group, an alkyl group, an aryl group, an alkoxy group or a group of

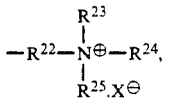

in which $R^{22}$ is a linkage group, $R^{23}$, $R^{24}$ and $R^{25}$ each represent a hydrogen atom, an alkyl group or an aryl group; and $X\ominus$ is a halogen atom, provided that $R^{21}$, $R^{22}$, $R^{23}$, $R^{24}$ and $R^{25}$ each may have a substituent.

2. The developer of claim 1, wherein said ammonium salt-modified polysiloxane is a polymer represented by the following Formula B:

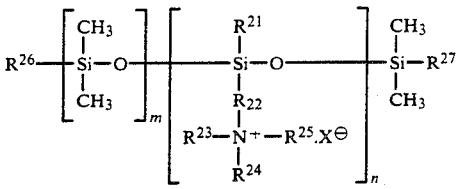

(B)

wherein $R^{26}$ and $R^{27}$ each represent a hydrogen atom, a hydroxyl group, an alkyl group, an aryl group or an alkoxy group, provided that $R^{25}$ and $R^{26}$ each may have a substituent, $R^{21}$, $R^{22}$, $R^{23}$, $R^{24}$, $R^{25}$ and $X\ominus$ are the same as defined in Formula A, and m and n are each an integer of 1 or more.

3. The developer of claim 1, wherein the thickness of said fluororesin coated on said magnetic particle is within the range of from 0.5 to 3.0 μm.

4. The developer of claim 1, wherein said alkali salt of fatty acid is a lithium salt of a fatty acid.

5. The developer of claim 1, wherein said multivalent metal constituting said multivalent metal compound is Cu, Be, Ca, Mg, Sr, Ba, Zn, Cd, Al, Ti, Ge, Sn, V, Cr, Mo, Mn, Fe, Ni, Co, Zr or Se.

6. The developer of claim 1, wherein said inorganic particle is silica, alumina, titanium oxide, barium titanate, strontium titanate, zinc oxide, chromium oxide, cerium oxide, antimon trioxide, zirconium oxide or silicon carbide.

7. The developer of claim 1, wherein the average primary particle diameter of said inorganic particle is within the range of from 3 nm to 2 μm.

8. The developer of claim 7, wherein the average primary particle diameter of said inorganic particle is within the range of from 5 nm to 500 nm.

9. The developer of claim 1, wherein said inorganic particle is contained in said toner in an amount of from 0.1% to 2% by weight of said colored particle.

10. The developer of claim 1, wherein said inorganic particle is contained in said toner in an amount of from 0.2% to 1% by weight of said colored particle.

* * * * *

UNITED STATES PATENT AND TRADEMARK OFFICE

CERTIFICATE OF CORRECTION

PATENT NO. : 5,104,762

DATED : April 14, 1992

INVENTOR(S) : Shirose et al.

It is certified that error appears in the above-identified patent and that said Letters Patent is hereby corrected as shown below:

Claim 1, col. 11, line 48: delete "XΘ" and insert therefor --$X^{\Theta}$--.

Claim 2, col. 12, line 11: delete "$R_{22}$" and insert therefor --$R^{22}$--;

line 19: delete "XΘ" and insert therefor --$X^{\Theta}$--.

Claim 6, col. 12, line 34: delete "antimon" and insert therefor --antimony--.

Signed and Sealed this

Twenty-fourth Day of August, 1993

Bruce Lehman

*Attest:*

BRUCE LEHMAN

*Attesting Officer*

*Commissioner of Patents and Trademarks*